United States Patent [19]

Spiegelman et al.

[11] 4,202,755

[45] May 13, 1980

[54] CATALYTIC METHOD FOR MAKING PITCH

[75] Inventors: Gerald H. Spiegelman, Wayne; Harry B. Nickles, Glen Rock; Jack M. Solomon, West Caldwell, all of N.J.

[73] Assignee: Witco Chemical Corp., New York, N.Y.

[21] Appl. No.: 957,762

[22] Filed: Nov. 3, 1978

[51] Int. Cl.[2] ..... C10C 3/04

[52] U.S. Cl. ..... 208/5; 208/46

[58] Field of Search ..... 208/4, 5, 6

[56] References Cited

U.S. PATENT DOCUMENTS

| | | | |
|---|---|---|---|
| 2,179,208 | 11/1939 | Burk et al. | 208/4 |
| 2,287,511 | 6/1942 | Burk et al. | 208/5 |
| 4,096,056 | 6/1978 | Haywood et al. | 208/5 |

*Primary Examiner*—Veronica O'Keefe

*Attorney, Agent, or Firm*—Albert L. Gazzola; Morton Friedman

[57] ABSTRACT

A method for making pitch from petroleum bottoms fractions by air blowing in the presence of about 1 percent by weight of metallic sodium. The method reduces processing time by about one-third and the product is of the desired high density of about 1.25 g/ml. to above 1.30 g/ml. at 25° C.

6 Claims, 1 Drawing Figure

CATALYTIC METHOD FOR MAKING PITCH

FIELD OF THE INVENTION

This invention relates to a method of producing petroleum pitch. Specifically this invention relates to a method of making petroleum pitch wherein by catalytic activity the production rate and quality of the pitch is improved.

BACKGROUND AND DISCUSSION OF PRIOR ART

In manufacturing petroleum pitch, it is known to air blow a petroleum residuum while maintaining the temperature at about 650°-750° F. The procedure is very tedious, requiring a long duration of action in order to bring the material to useable characteristics of high melting point and low penetration.

Several attempts have been made to add catalysts to enhance the air blowing operation. In Fink et al, U.S. Pat. No. 2,627,498, granted Feb. 3, 1953, it was proposed to first add metal halide catalyst and then air blow; and in Thelen, U.S. Pat. No. 2,281,728, granted May 5, 1942, it was proposed to first treat the feedstock with hydrochloric acid prior to air blowing; while in Pitchford et al, U.S. Pat. No. 3,919,072, granted Nov. 11, 1975, metal chlorides are mentioned as catalysts for pre-treatment of the feedstock before air blowing, for producing asphalts.

Burk et al, U.S. Pat. No. 2,179,208, granted Nov. 7, 1939, discloses air blowing of petroleum residuum wherein, in a post heat treatment a catalyst is used for producing an asphalt. A broad list of catalysts is disclosed, the preferred catalysts being metal halides and inorganic acids, and although metallic sodium is disclosed, it is not preferred.

There is no indication in the prior art of the effectiveness of metallic sodium in the concentrations as disclosed, herein, for producing a high grade pitch at a faster production rate.

It is therefore a principal object of this invention to provide an improved method of obtaining pitch from petroleum bottoms.

It is another object of this invention to provide a method as aforesaid wherein petroleum bottoms are air blown with a reduced residence time than heretofore.

It is still another object of this invention to provide a method as aforesaid in which the product pitch has a high density.

It is also a further object of this invention to produce a high density petroleum pitch by a method that is practical and efficient in design and operation, and provides a reduction in the equipment requirements for pitch production.

The aforesaid as well as other objects and advantages will become more apparent from a reading of the following disclosure, the adjoined claims and the accompanying drawings in which:

FIG. 1 is a graph of the density of the product pitch versus air blowing time for a petroleum bottom feedstock with and without different amounts of specific catalyst.

DESCRIPTION OF THE PREFERRED EMBODIMENTS

Figure 1:
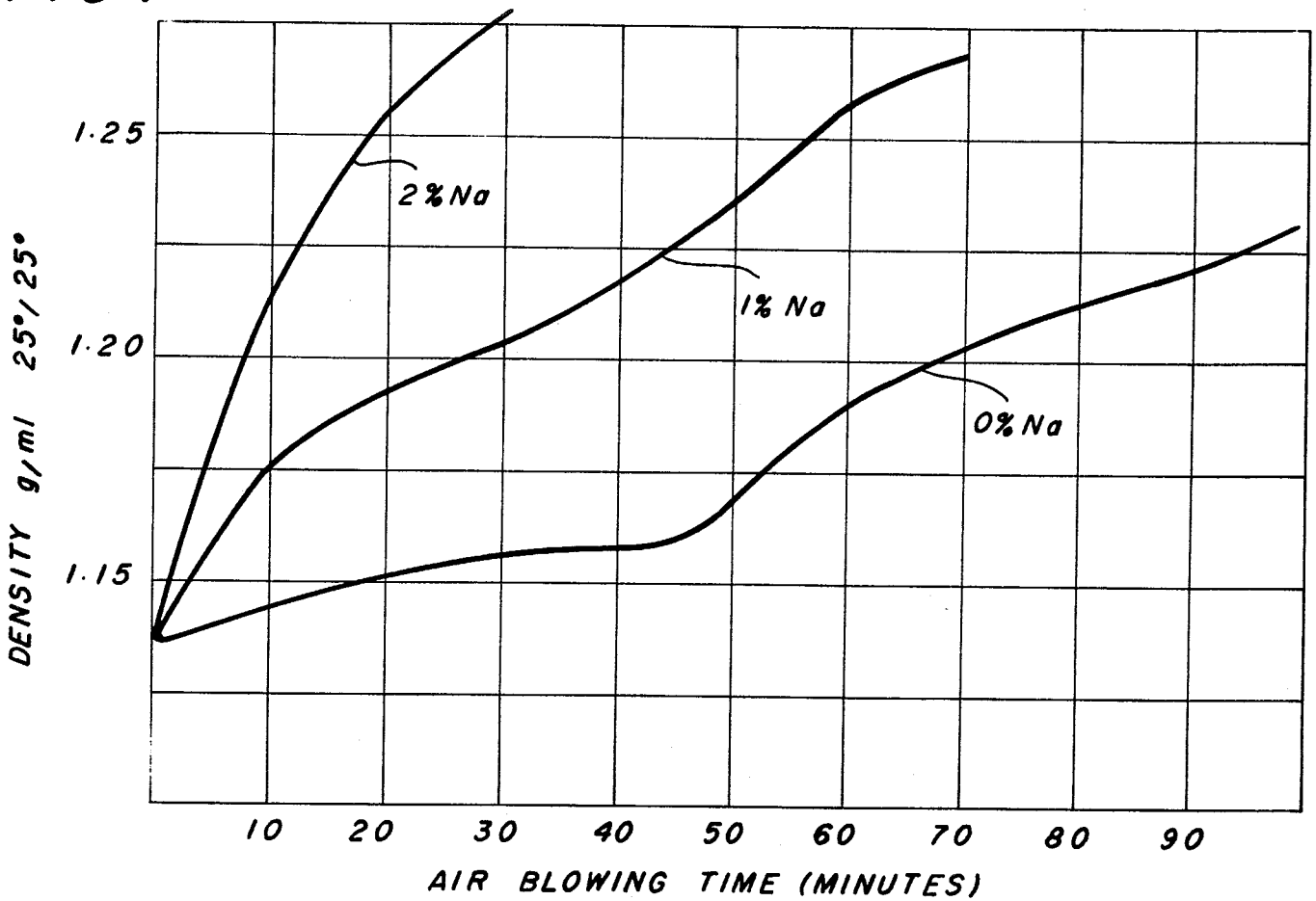

Broadly speaking this present invention comprises blowing a petroleum bottom feedstock with air or other source of oxygen in the presence of specific amounts of metallic sodium for limited periods to produce a high density pitch.

In a more specific aspect this present invention is a method for making pitch which comprises; air blowing a bottoms fraction in the presence of 0.5 percent to about 5.0 weight percent of metallic sodium at about 650°-750° F. for a period of from 5 minutes to about 200 minutes, whereby the product pitch has a specific gravity of at least about 1.20 25/25.

In still a more particular aspect, this invention is a method for producing petroleum pitch which comprises: (a) adding 0.5 to 1.5 weight percent of metallic sodium to a petroleum bottoms feedstock; and (b) passing a source of oxygen therethrough at the rate of up to 0.2 cu. ft./$O_2$/min./bbl. for a period of 15 to about 100 minutes at a temperature of from about 680° to 700° F., to produce a pitch having a specific gravity of about 1.25 25/25.

The rate of oxygen feed may be much higher than 0.2 cu. ft./min./bbl. but because of the safety factor to be considered in the production of large batches, this low concentration is preferred.

The charge mixture of petroleum bottoms feedstock and sodium is heated, preferably to a temperature below about 680° F., to allow for exothermic increase in temperature to about 700° F., while a source of oxygen is passed therethrough, the temperature being maintained between about 680° to 700° F., during oxidation. The rate and concentration of oxygen feed depends upon the nature of the petroleum bottoms feedstock, the quantity of the feedstock to be oxidized, for instance, and also depends upon the type of equipment available to safely conduct such oxidation-polymerization. During the oxidation the temperature is never permitted to increase beyond about 750° F. While the oxidation progresses, a light fraction and water by-products distill off and are collected separately. The reaction is complete at a point during the oxidation polymerization that a product having desired specific gravity is achieved.

The time required to produce a pitch having a specific gravity in excess of 1.20 25/25 is generally from 5 to 75 minutes and the time required to produce a pitch having a specific gravity in excess of 1.27 up to about 1.35 25/25 is from about 15 to 100 minutes, with the weight percent of metallic sodium present from 0.5 percent to about 3.0 weight percent and preferably from 0.5 weight percent to about 1.5 weight percent based on the weight of feedstock.

The petroleum feedstock employed in the present process may be any of the known feedstocks for making pitch. Generally, the feedstock is a bottoms fraction derived from the catalytic fractionation of petroleum hydrocarbons or modified bottoms fraction, such as clarified slurry oil from a fluid catalytic cracker, as is well known in the art. The bulk of the low boiling fractions, including water, i.e. boiling below 500° F., are removed from the heavy bottoms fraction before converting to the pitch by the present process, for best results. The feedstocks usually have a high aromatic content, i.e. above 75 to 80% and have an initial boiling point of above 500° F., and an end boiling point of up to 1100° F.

Potassium metal is expected to catalyze the present pitch process as does the sodium, but, because it is so much more highly reactive, thus contributing an unwanted risk, and because it is more costly, sodium is preferred.

The following examples are intended to illustrate the present invention and are not intended to be limiting thereto.

EXAMPLE I

Three topped clarified slurry oil samples are prepared containing the following percentages of metallic sodium; 0%, 1%, and 2%. The samples are each separately blown with air at 700° F. at the rate of 2 liters/minute/100 g. sample. The pitch density is determined at intervals from 5 to 90 minutes. The results obtained are shown in FIG. 1.

Referring specifically to FIG. 1, it is apparent that in the bottom curve representing air blowing without metallic sodium, in a period of 90 minutes, the pitch density is still less than within the desired range. In contrast the middle curve shows that addition of 1% sodium gives a pitch having a specific gravity of 1.23 25/25 in 50 minutes, and the top curve (2%Na) shows a pitch product having a specific gravity of 1.23 25/25 in 15 minutes.

EXAMPLE II

Samples of clarified slurry oil are treated with different catalysts and separately air blown for 30 minutes as in Example I. The pitch densities of each product are shown below:

| | | Specific Gravity at 25/25 |
|---|---|---|
| A - Sodium Catalyst | (1%) | 1.281 |
| B - Copper Chromite " | (1%) | 1.235 |
| C - Sulfuric Acid " | (1%) | 1.240 |
| D - Sodium Sulfite " | (2%) | 1.232 |
| E - No Catalyst | | 1.225 |

The foregoing results clearly demonstrate the superiority of the sodium catalyst.

As is seen from the foregoing, by employing metallic sodium catalyst, a high density pitch is prepared with concomitant reduction in reaction time. The present invention is successful in producing pitches with specific gravities above 1.30 25/25.

The high density pitch produced by the present invention is useful as binder pitch in the production of electrodes, but is not restricted thereto. In addition, binder pitches for use as fiberboard pitch or as pipe saturates, for instance, as known in the art, can be made by the present process.

While there is described certain preferred embodiments it is possible to have modifications and variations thereof without departing from the spirit or scope of the invention.

The embodiments of the invention in which an exclusive property or privilege is claimed are defined as follows:

1. A method for making petroleum pitch comprising passing an oxygen containing gas source through a petroleum bottoms feedstock containing metallic sodium in amounts of 0.5 to about 5.0 weight percent at a temperature in the range of 650° to 750° F. for from about 5 to 100 minutes to obtain a pitch having a specific gravity of up to about 1.35 25/25.

2. The method of claim 1, wherein the oxygen source is fed at a rate of 0.01 to 0.2 cu. ft. $O_2$/min./bbl.

3. The method of claim 2, wherein the feedstock is heated to a temperature between about 680° to 700° F.

4. The method of claim 3, where the reaction period is 15 to 100 minutes.

5. The method of claim 1, wherein the sodium is present in an amount of from 0.5 to about 1.5 weight percent.

6. The method of claim 5, wherein the pitch has a specific gravity of 1.27 to 1.35.

* * * * *